United States Patent [19]

Bulso, Jr. et al.

[11] Patent Number: 4,715,208

[45] Date of Patent: Dec. 29, 1987

[54] METHOD AND APPARATUS FOR FORMING END PANELS FOR CONTAINERS

[75] Inventors: Joseph D. Bulso, Jr., Canton; James A. McClung, North Canton, both of Ohio

[73] Assignee: Redicon Corporation, Canton, Ohio

[21] Appl. No.: 924,981

[22] Filed: Oct. 30, 1986

[51] Int. Cl.[4] ..... B21D 51/44

[52] U.S. Cl. ..... 72/348; 72/336

[58] Field of Search ..... 72/329, 336, 348, 354

[56] References Cited

U.S. PATENT DOCUMENTS

| | | | |
|---|---|---|---|
| 368,821 | 8/1887 | Edmands | 72/348 |
| 2,239,897 | 4/1941 | Lyon | 72/348 |
| 3,902,347 | 9/1975 | Ridgway et al. | 72/336 |
| 4,109,599 | 8/1978 | Schultz | 113/121 |
| 4,559,801 | 12/1985 | Smith et al. | 72/348 |
| 4,567,746 | 2/1986 | Bachmann et al. | 72/348 |
| 4,571,978 | 2/1986 | Taube et al. | 72/349 |
| 4,577,774 | 3/1986 | Nguyen | 220/66 |
| 4,587,825 | 5/1986 | Bulso, Jr. et al. | 72/329 |
| 4,587,826 | 5/1986 | Bulso, Jr. et al. | 72/329 |

*Primary Examiner*—Lowell A. Larson

*Attorney, Agent, or Firm*—Reese Taylor

[57] ABSTRACT

A method of forming a container end panel having a countersink radius and a chuckwall including preforming the radius and the chuckwall so that the chuckwall includes a straight wall portion tangent to the radius and reforming and reducing the radius without tooling restraint while holding pressure against the straight wall area. Apparatus for performing the method includes a punch core and a cooperating die core ring having complimental geometry for forming the chuckwall and radius configuration. The article formed by the method and apparatus includes an end panel having a straight wall portion between the normal tapered wall portion and countersink radius.

6 Claims, 12 Drawing Figures

METHOD AND APPARATUS FOR FORMING END PANELS FOR CONTAINERS

BACKGROUND OF THE INVENTION

This invention relates, in general, to forming end panels which are intended to be double seamed on two- or three-piece containers and relates, in particular, to an improved method and apparatus for forming the countersink radius and chuckwall of such end panels and to the end panel formed thereby.

DESCRIPTION OF THE PRIOR ART

Containers, or cans, of metal or other material are well-known in the art, with these containers primarily being used for food or beverages, but having other applications for other products as well.

These containers are either of the two-piece or three-piece variety but, in any event, the end closures, which are required to complete the containers, are normally seamed by a double-seam operation onto the end, or ends, of the container by means of a seaming chuck which engages a frusto-conical wall.

It thus becomes necessary to produce an end panel having a central bottom panel and a peripheral seaming flange suitable for such double-seaming operation, and interconnected by opposed tapering or frusto-conical walls which are joined by a countersink radius. One of these wall is intended to engage the seaming chuck and is commonly referred to as the "chuckwall". In view of the fact that the seaming operation is critical to the successful closing of the container, it is imperative that the chuckwall be smoothly formed during the end panel forming operation so as to insure suitable engagement with the seaming chuck.

Additionally, finished containers of this general nature require considerable buckle resistance, since many of the products which are contained in the containers are packed under pressure of up to ninety (90) P.S.I. It is, therefore, necessary to ensure that the radius area is as tight, or small, as possible so as to provide the optimum buckle resistance. It would, of course, be possible to provide virtually any buckle resistance, if one were willing to increase metal thickness. However, in view of the fact that literally billions of these end panels are produced annually, it is, for obvious reasons, desirable to reduce metal thickness as far as possible for economic reasons.

The problem, therefore, becomes one of producing the desired radius and, consequently, the desired buckle resistance strength with minimal use of material.

Various end panels and conventional methods and apparatus for forming the same can be seen in the variety of patents, such as Bulso U.S. Pat. No. 4,587,825 and Bulso U.S. Pat. No. 4,587,826, as well as Nguyen U.S. Pat. No. 4,577,774 and Smith U.S. Pat. No. 4,559,801. For example, in the Bulso patents the chuckwall and the radius are formed with suitably designed tooling and the chuckwall is shortened and the radius reduced in a reforming operation.

In Schultz U.S. Pat. No. 4,109,599, the chuckwall is shortened and the radius is reduced in a reforming operation wherein the flange is gripped and forced downwardly to fold or bend the material at the radius area to thus form the countersink radius without the assistance of any tooling.

Taube U.S. Pat. No. 4,571,978 also discloses formation of the countersink radius in an unrestrained manner.

All of these patents, in various ways, disclose methods and apparatus for improving the buckle resistance in the critical area and all of them are, more or less, presumably effective for the purposes for which they are designed.

For example, while the radius of curvature in the countersink area may well be reduced as suggested by Schultz and Taube, thereby achieving one of the objectives, wrinkling in the wall area is likely due to the absence of restraint.

Therefore, it has been found that both optimum requirements can be best met by the method and apparatus of the present invention.

Those objects are to provide the optimum buckle resistance with the minimal use of material, while still maintaining the smoothness of the chuckwall and the concentricity of the countersink radius.

SUMMARY OF THE INVENTION

It has been found that the aformentioned objectives can be achieved by providing a method of forming a container end panel wherein the bottom center panel is preliminarily formed and the countersink radius is preliminarily formed by a punch having a radiused nose thereon, following which the end piece is reformed to reduce the radius while still holding pressure against the chuckwall area during this operation to avoid wrinkling.

It has been found that this method is further enhanced if the chuckwall is initially formed with a tapered portion, or area, leading from the flange toward the center panel and joined to and continuing on in a vertical wall portion tangential with the radius.

In reforming, then, at least a portion of the straight wall area is retained, since pressure is maintained against that wall and the inner wall of the die core ring, so that the chuckwall is unaltered after its initial formation thereby insuring that it is unwrinkled. In the same fashion, by forming the countersink in this manner, the radius can be reduced even though part of the forming operation is performed with tooling.

Furthermore, it has been found that the provision of the short, straight or vertical segment of the wall area further enhances buckle resistance.

It has been found that this method can be achieved by the utilization of a punch having an enlarged radiused nose, a straight outer wall and a tapered wall so that the configuration just referred to can be initially formed in the chuckwall and radius area of the end panel, following which, as the punch is retracted, the straight wall area of the punch will serve to hold the straight wall area of the preliminarily formed end panel against the straight wall area of the die core ring, thereby insulating the chuckwall itself from any wrinkling, but permitting the countersink radius to be reduced.

Accordingly, production of an improved method and apparatus for forming end panels of the type above described and the end panel formed thereby becomes the principal object of this invention, with other objects thereof becoming apparent upon the reading of the following brief specification considered and interpretated in view of the accompanying drawings.

OF THE DRAWINGS

DESCRIPTION OF THE PREFERRED EMBODIMENTS

It will first be noted that the apparatus and method of the present invention are primarily intended to be utilized in conjunction with a double-acting press having inner and outer rams which are independently movable and controllable with respect to each other. A press of this type has not been described in great detail since such presses, as exemplified in Ridgway U.S. Pat. No. 3,902,347, are well-known in this art.

Figure 1:
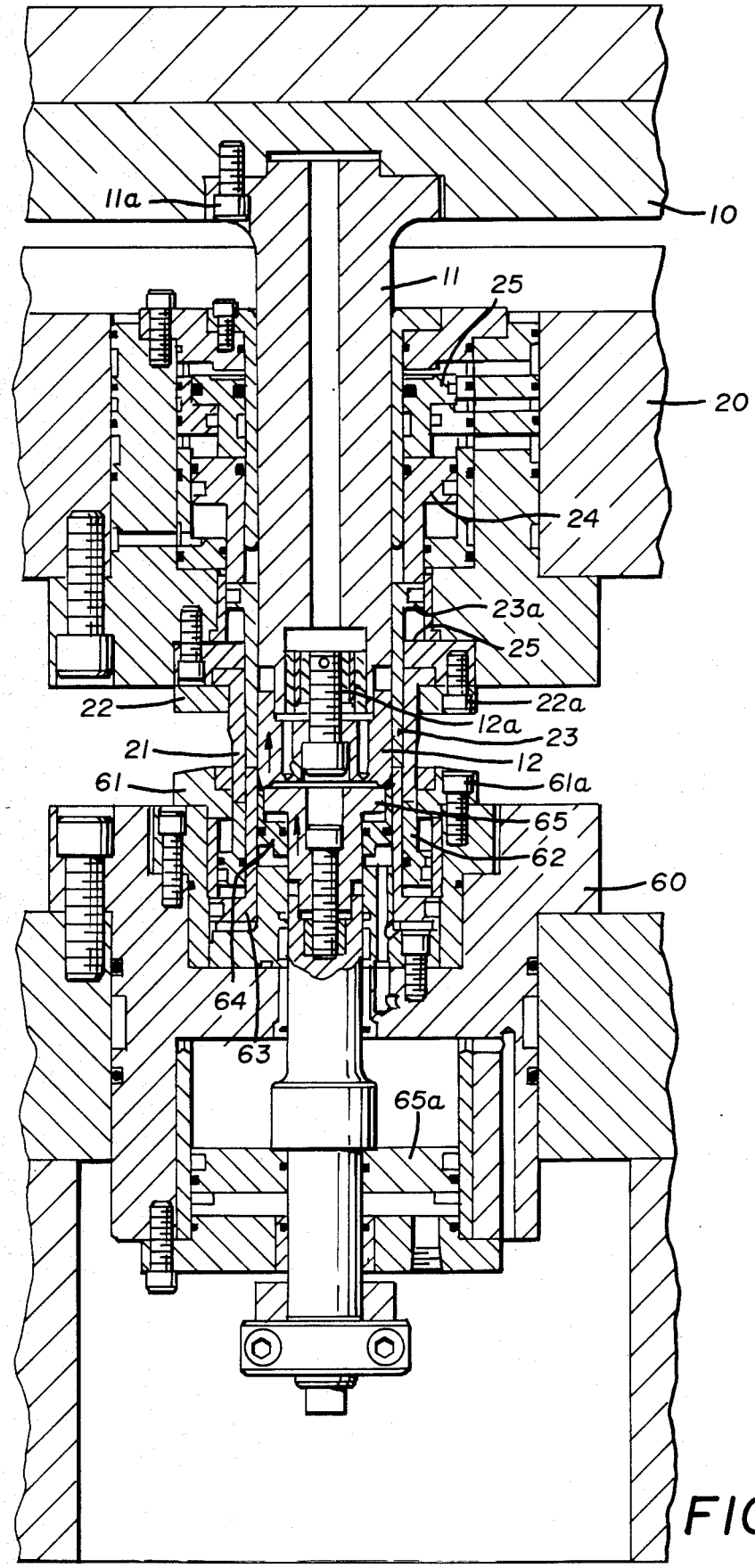
FIG. 1 is an elevational view, in section, showing the overall assembly of the various tooling components of the invention.

Referring, then, to FIG. 1 first for a general review of the various tooling components, it will be noted that the inner ram 10 has a punch core holder 11 secured thereto by one or more screws 11*a*. A punch core 12 is secured at the distal end of the punch core riser 11 by the adjustment screw 12*a*.

Reference to the other views of the drawings, and particularly to views 4A through 5E which are on a larger scale than FIG. 1, will permit a more detailed examination of the punch core 12.

It will thus be seen that the punch core 12 has an annular radiused nose area 12*b* projecting from its bottom surface. The punch core also has a tapered sidewall 12*c* which extends from a straight sidewall thereof downwardly toward the radiused area 12*b* and terminating in a straight wall area 12*d* which is then tangential with the radiused area 12*b*. The significance of this geometry will be noted below.

Referring, again then, to FIG. 1 of the drawings, it will be noted that the outer ram 20 carries on it a punch shell 21 which is secured by a punch shell retainer 22 and one or more suitable screws 22*a*.

Radially inboard from the punch shell 12 is first pressure sleeve 23 and one or more pistons 24 and 25 which are disposed above it and which act on it in response to fluid pressure with first pressure sleeve 23 being reciprocal with respect to ram 20.

The base 60 of the press is disposed opposite inner and outer rams 10 and 20 and carries a cut edge 61 secured thereto by one or more screws 61*a*.

Radially inboard of the cut edge 61 is a second pressure sleeve 62 which is fluidly supported on the base 60 in opposed relationship to punch shell 21.

Still further radially inwardly is a die core ring 63 which is fixedly supported on the base 60 and yet further inboard is knockout piston 64 which is fluidly supported on the base. Die core ring 63 is disposed opposite first pressure sleeve 23 while knockout piston 64 is disposed opposite the radiused nose 126 of punch 12.

Die core ring 63 also has specific geometry as can again best be seen from FIGS. 4A through 5E. Thus, the upper end has a radiused nose 63*a* which leads to a downwardly and inwardly tapering wall 63*b*. Wall 63*b* terminates in a straight wall 63*c*. This geometry enables the die core ring 63 to cooperate with punch 12 as will be described below.

A die core 65 completes the tooling area by the base 60, with this die core being movable relative to base 60 by the piston 65*a*.

Figure 2:
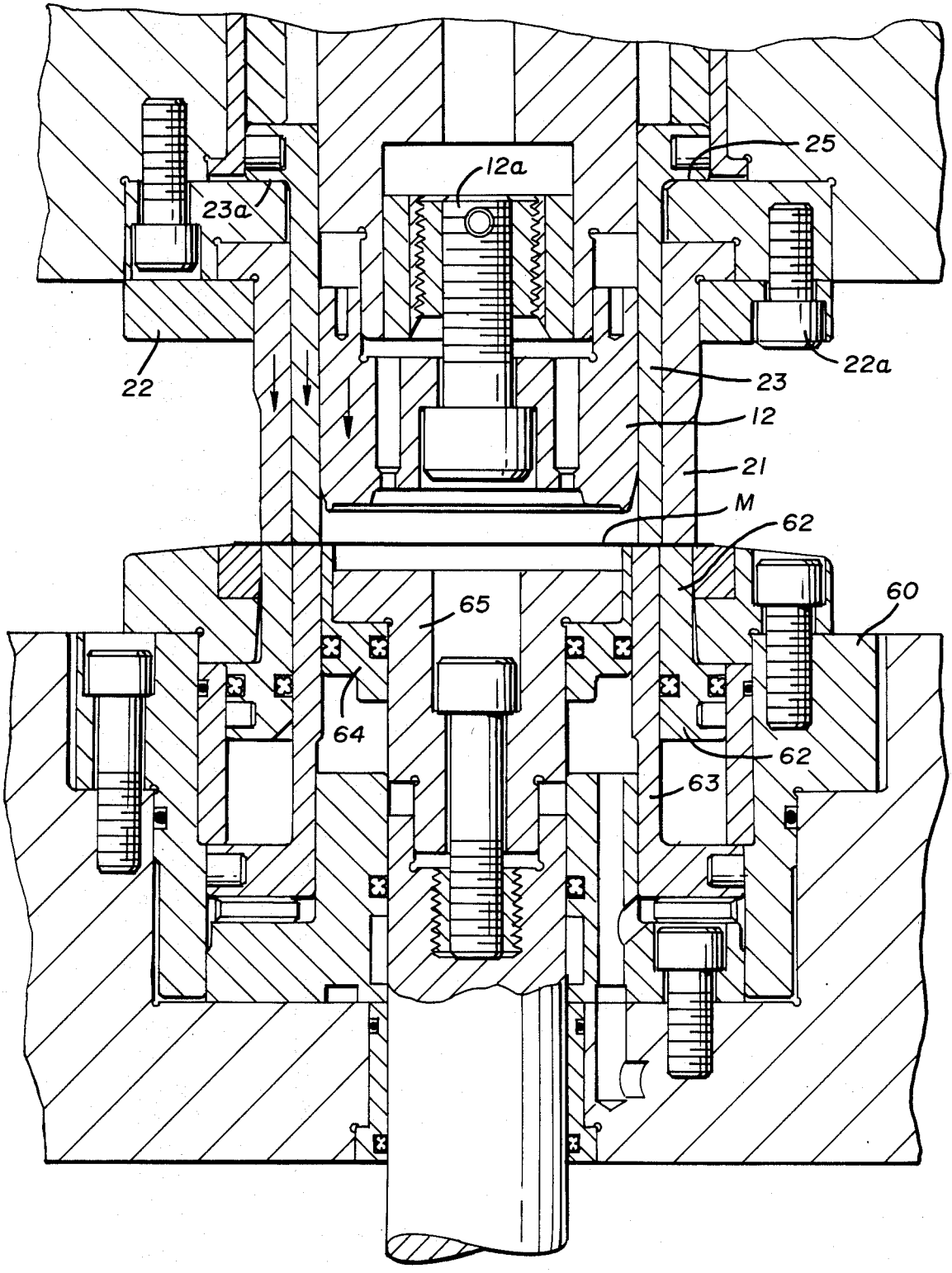
FIGS. 2 through 6 are proportionally schematic, elevational views showing the various positions of the apparatus during various stages of the forming operation.

Referring, then, to FIGS. 2 through 6 of the drawings for a description of the operation of the apparatus and method of the present invention, it will be seen from FIG. 2 that the material M has been inserted into the press, either in sheet form or from a coil of material, and is interposed between the inner and outer rams 10 and 20 in the base 60.

In FIG. 2, it will be seen that the punch shell 21 and the first pressure sleeve 23 have been advanced downwardly as indicated by the arrows so that they engage the top surface of the metal M, with the bottom being supported by the top edge of the second pressure sleeve 62 and the die core ring 63.

Figure 3:
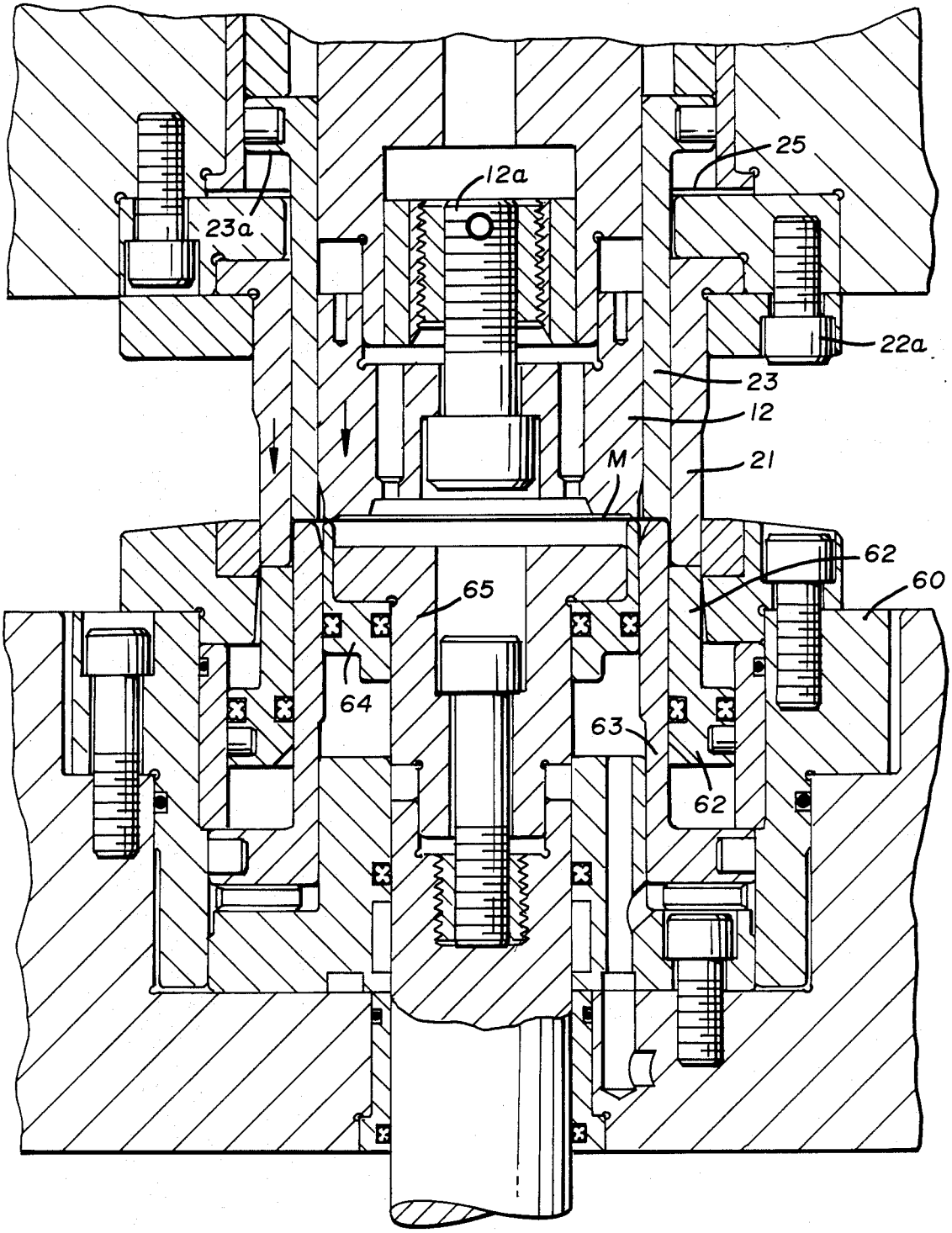

Further advancement of the tooling will lead to blanking of the material M against the cut edge 61 and wiping of the peripheral edge thereof about the periphery of the top of the die core ring 63, so as to form what might be called an inverted or reversed cup, as illustrated in FIG. 3 of the drawings.

It will be noted also here that the punch shell 12 has advanced so that it has just come into contact with the top surface of the center part of the reverse cup thus formed. It will further be noted that the punch shell 21 has overcome the fluid pressure supporting the second pressure sleeve 62, but that the die core ring 63 is fixed and remains in place.

Figure 4:
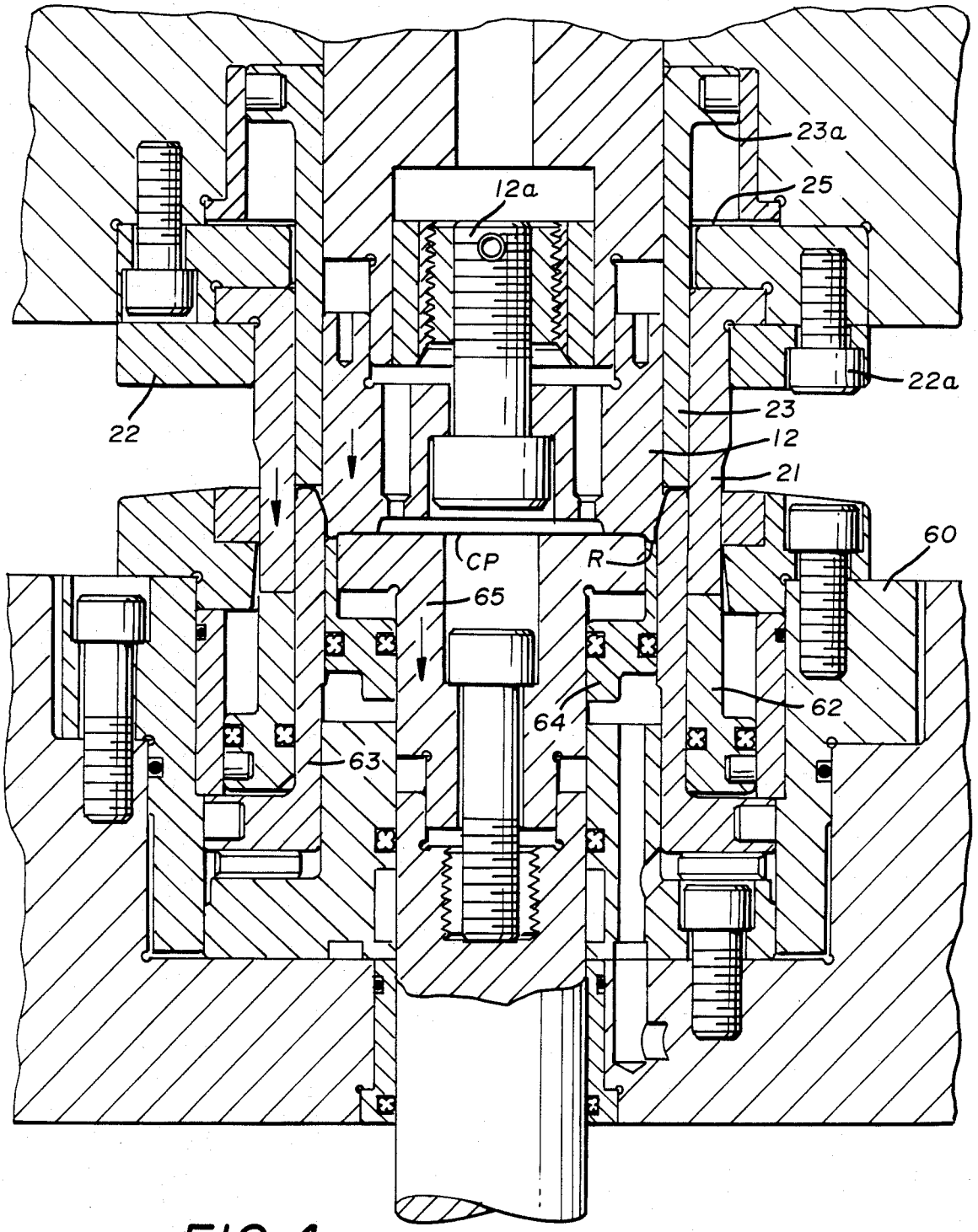
Figure 4A:
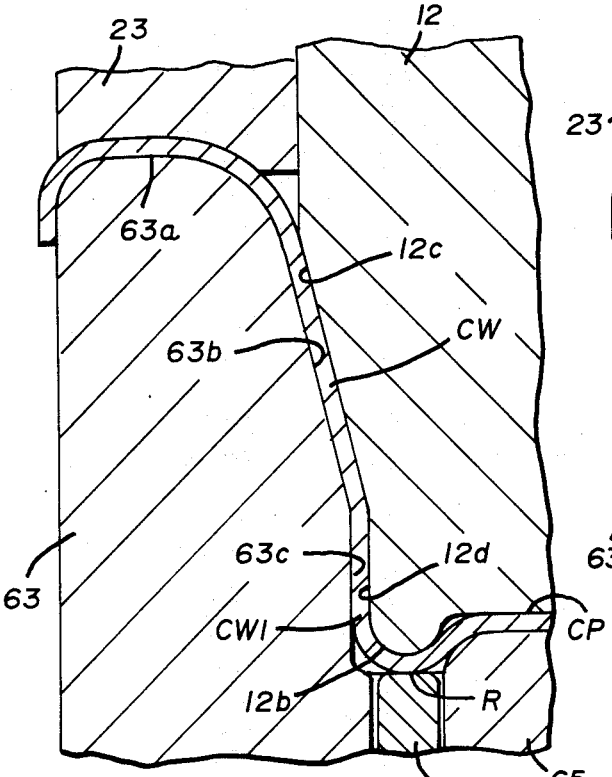
Figure 5A:
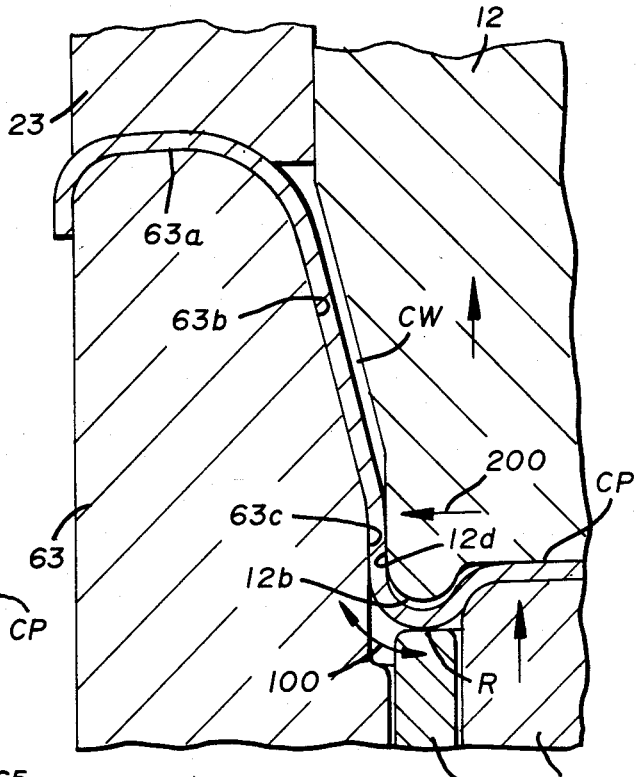
Figure 5B:
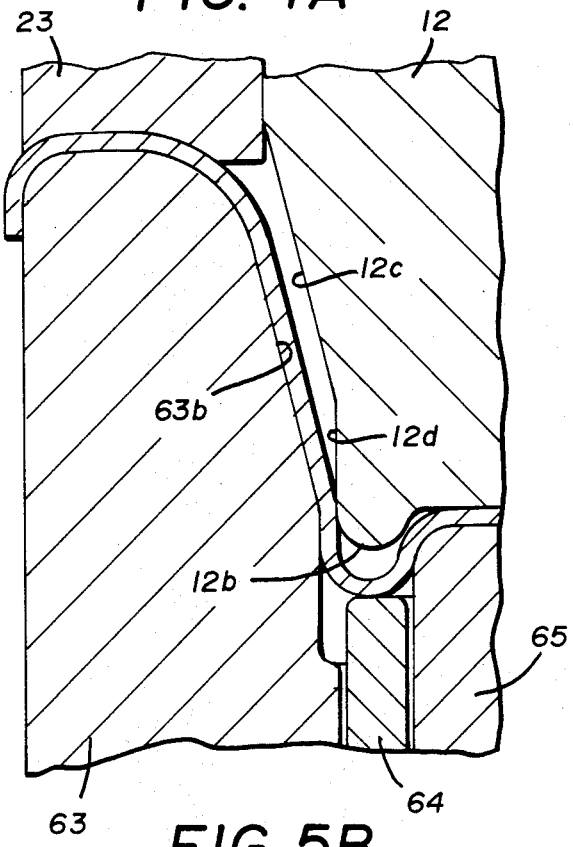
Figure 5C:
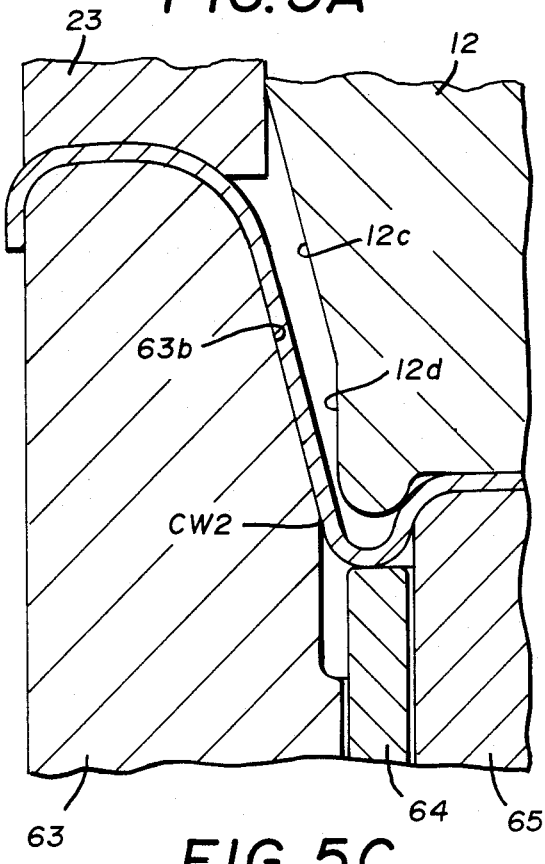
Figure 5D:
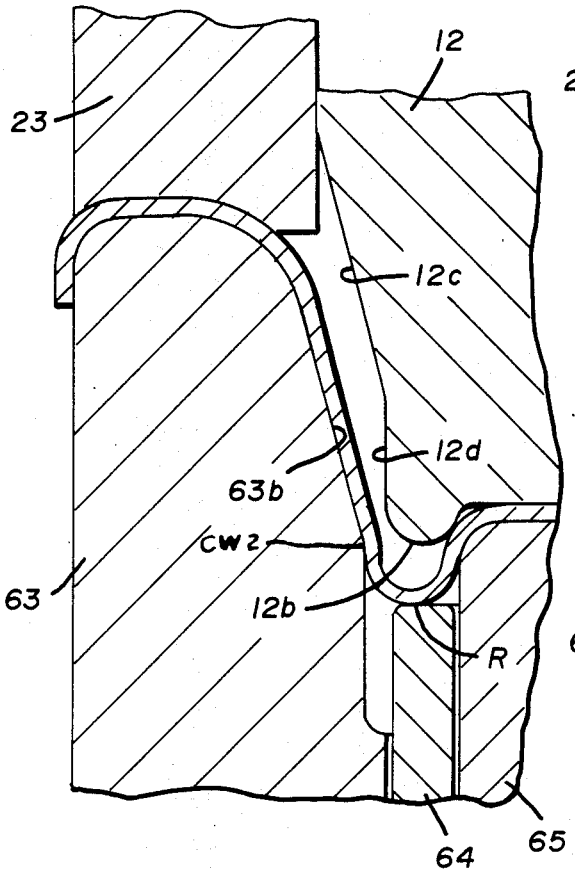
Figure 5E:
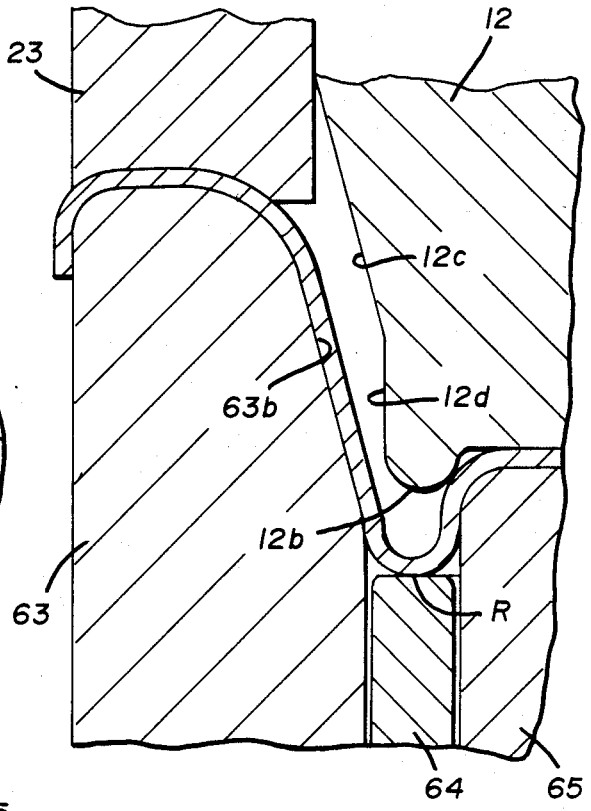

The result of further advancement of the tooling can be shown in FIG. 4 of the drawings, wherein the punch shell 12 has continued its downward advance in the direction of the arrows and it has forced the die core 65 down. At this point, the center panel CP of the end panel has been preliminarily formed, as has the countersink radius R of the panel, by engagement of the annular nose 12*b* of the punch 12 with the material. Reference to FIG. 4A will show this arrangement.

Thus, from FIG. 4A, it can be seen that the tapered wall 12*c* of the punch core 12 has formed the chuckwall CW in cooperation with the tapered wall 63*b* of the fixed die core ring 63. It should also be noted, at this point, that the first pressure sleeve 23 is holding, and has held, the material against the top of the die core ring 63, so as to control the metal during this forming operation which results in a precisely dimensioned wall without wrinkles. It also should be noted, at this point, that the chuckwall CW is essentially in its final configuration at this stage and will not change and will not be affected by subsequent operations.

Also, the straight wall area 12*d* of punch core 12 and the straight wall area 63*c* of die core 63 will have formed the straight wall portion CW1 on the end panel.

Still referring to FIG. 4A, it will be noted that the radiused nose 12*b* of the punch core 12 has formed the radius R. In practice, this radius will be oversized at this point. For example, in one typical application, at this point, the radius will be 0.030 inches. It will also be noted that the center panel CP has been preliminarily formed at this point.

Figure 5:
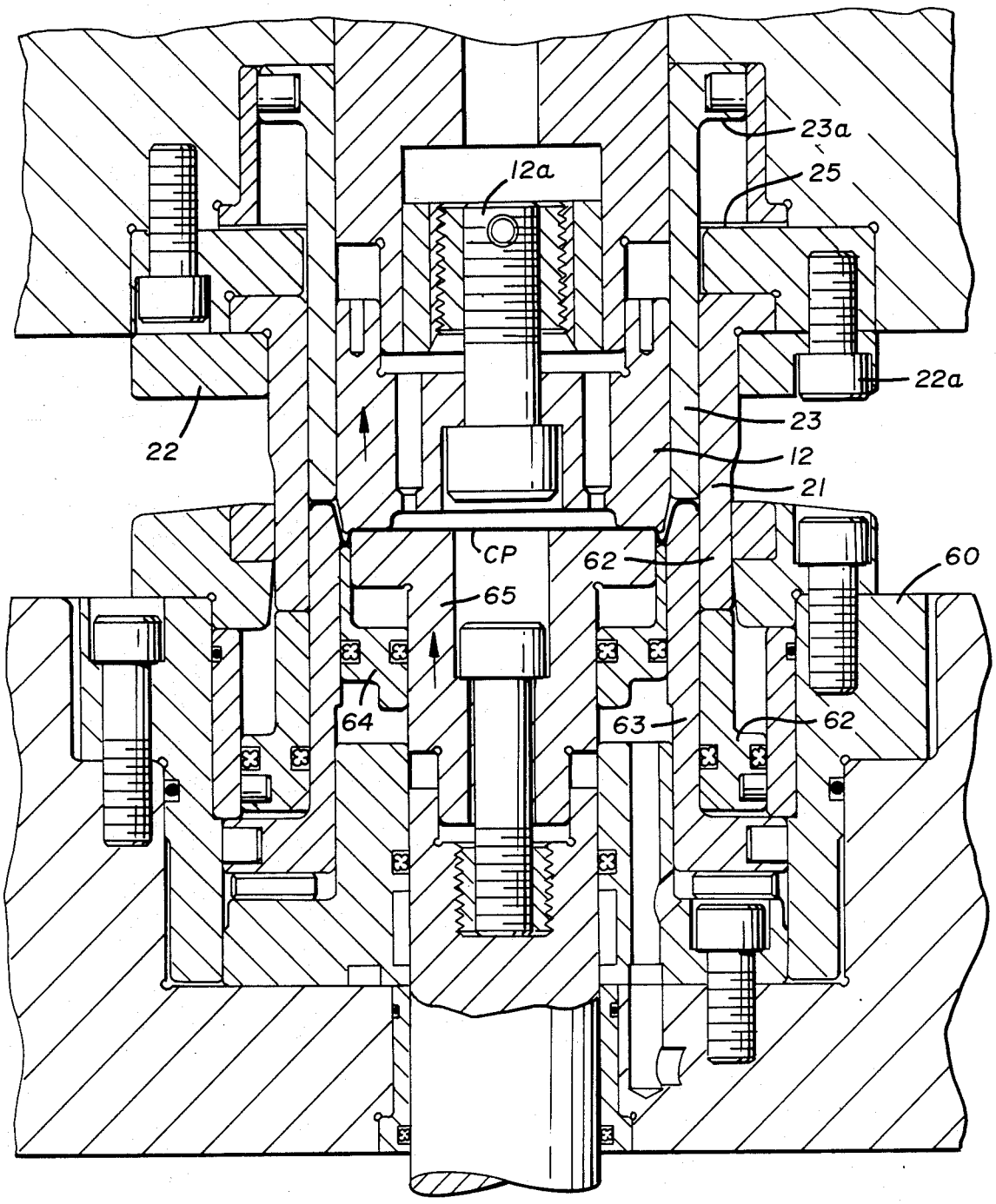

Referring, then, to FIG. 5 of the drawings, it should first be noted that FIGS. 5A through 5E represent, in a larger scale, the various positions of the tooling as the radius R is finally set. Furthermore, the FIG. 5 position in the stage of operations sequence of drawings generally corresponds to the main assembly figure of the drawings in FIG. 1.

In any event, it will be noted that starting with FIG. 4A, the vertical wall area 12d of the punch core 12 will be in engagement with a vertical wall area CW1 on the end panel and will be holding it against the vertical wall 63c of the die core ring 63.

At this point, the inner ram 10 will begin to pull away from the base 60, taking with it, of course, the punch core 12. It will be followed in its upward direction by the die core 65, as clearly illustrated by the arrows in FIG. 5A, for example. The nose 12b of the punch will also begin to pull out of the radius R of the end panel. However, for at least a portion of this travel, holding pressure in the direction of the arrow 200 will be held between vertical wall 12d of the punch core 12 and vertical wall 63a of the die core ring 63. This insures that the chuckwall CW is unaffected by the tooling movement through this stage of operation.

Effectively, what happens then is that the metal is pulled vertically in the direction of the arrow 100 to tighten up the radius R of the end panel, since the radiused nose 12b of the punch core 12 has lifted away from the inner surface of the radius R of the end panel. This permits the radius to be reduced, in a typical case, to 0.020 inches. It ought to be noted here, however, that by virtue of the holding force on the vertical wall surfaces, the location of the radiused area R, with respect to the overall end panel, is unchanged, thereby enhancing the concentricity of the countersink radius which is of considerable importance in the final double-seaming operation when the container itself is assembled.

It also should be noted that it has been found that the radius of nose 12b is preferrably held to three times metal thickness or less so as to insure that a true radius R is obtained during the reforming operation.

Figure 6:
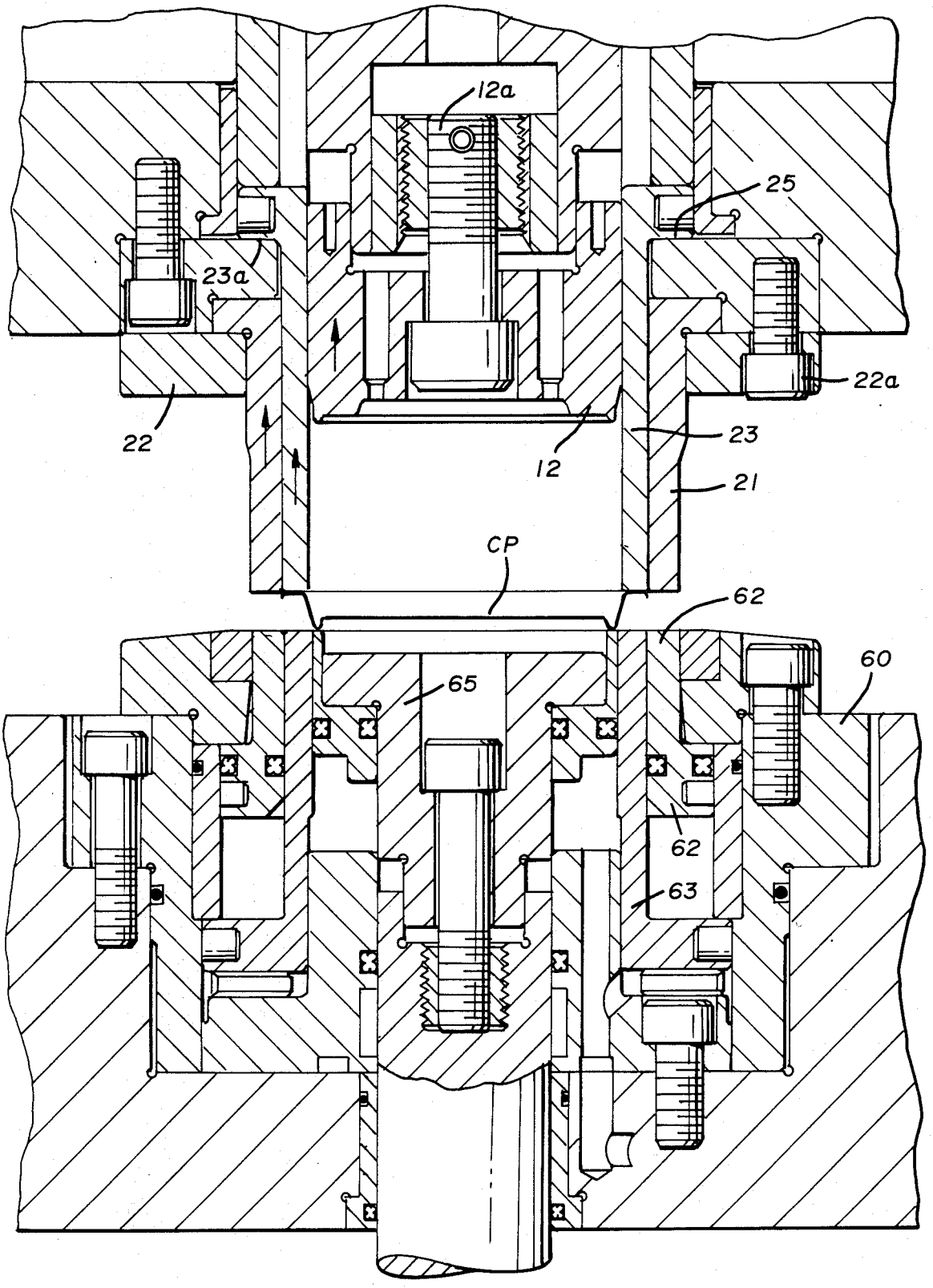

FIG. 6, of course, shows the lift-out position wherein all of the tooling carried by inner rams 10 and 20 has lifted away from the base 60 and the knockout ring 64 has been elevated by its supporting fluid pressure to lift the finished end panel out.

It also will be noted, however, that the finished end panel retains a slight vertical wall CW2 since the tensile strength thereof has been increased by compression.

The result of employment of the method and apparatus just described is an improved end panel for at least three reasons.

First, the chuckwall is formed, positively, by tooling. This makes it possible to avoid wrinkling in this area, thereby enhancing the ultimate engagement of this wall with the seaming chuck.

Second, the countersink radius area is tightened up to the desirable radius without the material being drawn around a sharp tooling radius and without affecting the chuckwall at all and is maintained in true concentricity primarily by virtue of the fact that the holding force during the tightening operation is in the straight wall area.

Third, the resulting end panel includes, in addition to the normal chuckwall and countersink radius, a short straight wall area CW1 which provides enhanced buckle resistance.

All this is accomplished without the normal thinning which occurs when the tight radius is pulled around tooling and also is accomplished without the wrinkling in the chuckwall area which occurs when the radius area is tightened without any restraint at all. It will, however, be noted that the wall CW2 is carefully controlled as to thickness and could even be thinned if desired.

While a full and complete description of the invention as been set forth in accordance with the dictates of the Patent Statutes, it should be understood that modifications can be resorted to without departing from the spirit hereof or the scope of the appended claims.

What is claimed is:

1. A method of forming a container end piece from a blank of material comprising the steps of:

(A) initially forming an end piece having a central panel and a peripheral flange interconnected by a countersink radius adjacent said central panel and a tapered chuckwall leading from said flange to said radiused area with said wall being tapered toward said central panel for a portion of its length and terminating in a vertical segment adjacent said radiused area; and (B) reforming the end piece initially formed to reduce the radius while maintaining at least a portion of said vertical segment in a vertical condition.

2. The method of claim 1 wherein said initial forming includes forming the radiused area with a punch having an annular nose with a radius greater than the reduced radius produced by the reforming step.

3. The method of claim 1 wherein holding pressure is maintained against at least a portion of said vertical segment of said wall during at least a portion of said reforming.

4. Apparatus for forming a container end piece from a blank of material comprising:

(A) a base;

(B) a die core carried by said base for movement relatively thereof;

(C) a die core ring carried by said base in concentric relationship with said die core;

(D) a punch core disposed in opposed relationship with and movable toward and away from said die core;

(E) a first pressure sleeve disposed in opposed relationship with and movable toward and away from said die core ring;

(F) said die core ring being radially spaced from said die core; and (G) said punch core having a projecting annular nose movable into the space between said die core and said die core ring to preliminarily form a radiused area in the blank of material.

5. The apparatus of claim 4 wherein said die core ring has upper and lower ends; said punch core has a projecting lower end; and one wall surface of said upper end of said die core ring and the outer peripheral wall of said lower end of said punch core are complementally configured.

6. The apparatus of claim 5 wherein said one wall surface of said die core ring tapers downwardly and inwardly for a portion of its length and terminates in a straight wall portion; and said peripheral wall of said punch core tapers downwardly and inwardly and terminates in a straight wall portion.

* * * * *